US006966073B2

(12) United States Patent
Lee

(10) Patent No.: US 6,966,073 B2
(45) Date of Patent: Nov. 22, 2005

(54) SOCK

(76) Inventor: Timothy Lee, 131 W. 35th St., 10th Floor, New York, NY (US) 10001

( * ) Notice: Subject to any disclaimer, the term of this patent is extended or adjusted under 35 U.S.C. 154(b) by 0 days.

(21) Appl. No.: 10/726,094

(22) Filed: Dec. 1, 2003

(65) Prior Publication Data

US 2005/0115283 A1 Jun. 2, 2005

(51) Int. Cl.[7] ..... A41B 11/00

(52) U.S. Cl. ..... 2/239; 66/186; 66/187

(58) Field of Search ..... 66/178 R, 179, 66/180, 181, 182, 183, 184, 185, 186, 187, 66/188; 2/239, 241

(56) References Cited

U.S. PATENT DOCUMENTS

| | | | | | |
|---|---|---|---|---|---|
| 2,003,189 | A | * | 5/1935 | Heinitz | 66/187 |
| 2,250,257 | A | * | 7/1941 | Eissner et al. | 66/187 |
| 2,431,204 | A | * | 11/1947 | Sheppard | 66/187 |
| 2,474,894 | A | * | 7/1949 | Gottschalck | 66/183 |
| 2,694,306 | A | * | 11/1954 | Miller | 66/187 |
| 4,194,249 | A | | 3/1980 | Thorneburg | |

* cited by examiner

*Primary Examiner*—Danny Worrell
(74) *Attorney, Agent, or Firm*—Ostrolenk, Faber, Gerb & Soffen, LLP

(57) ABSTRACT

A sock having a foot portion, a leg portion, and a heel portion between the leg portion and the foot portion. The heel portion has a double gore line configured so that the foot portion is at an angle of substantially 90° to the leg portion.

9 Claims, 1 Drawing Sheet

SOCK

BACKGROUND OF THE INVENTION

The present invention relates to hosiery, and particularly to socks.

It is customary in the manufacture of socks to knit the socks so that when the unworn sock lies flat the foot portion of the sock is at an obtuse angle to the leg portion of the sock, as shown in FIG. 1. Such socks and their production are well known in the art and, thus, further discussion thereof will not be provided herein. The problem with such prior art socks is that the foot and ankle of most human beings are not normally at an obtuse angle to one another. The vast majority of the time, the ankle and foot are at substantially 90 degrees to one another. This 90°angle requires that the prior art socks be stretched in order to fit on the wearer's foot and ankle in the most frequent position of the foot relative to the ankle, i.e., 90°.

Furthermore, the leg portion of the sock which covers at least a portion of the leg of the wearer is cylindrically shaped and of a uniform diameter. Elastic is normally knitted into the leg portion of the sock so that the sock can stretch and contract to conform to the shape of the leg. As is known, the lower leg of most human beings is not of uniform diameter, but instead tapers downwardly from the calf to the shin. This change in diameter of the lower leg causes the sock to stretch and after repeated use frequently results in the elastic in the sock becoming "stretched out" and not staying up on the leg.

SUMMARY OF THE INVENTION

Accordingly, it is an object of the present invention to provide a sock which forms substantially a 90° angle between the foot portion and the leg portion.

It is a further object of the invention to provide a sock with a leg portion that is tapered in order to prevent slipping of the sock down the leg.

Pursuant to these objects, and others which will become apparent hereafter, one aspect of the present invention resides in a sock having a foot portion, a leg portion, and a heel portion between the foot portion and the leg portion. The heel portion has a double gore line so that the foot portion is at an angle of substantially 90° to the leg portion. The double gore line includes two gore line portions that are at an angle to one another and which meet at an apex so that the gore line portions extend downwardly from the apex and the gore line has a Y-shape.

In another embodiment of the invention, the gore line includes a line portion that extends away from the apex in a direction opposite to the two gore lines (i.e., toward the top of the sock).

In still another embodiment of the invention, the leg portion of the sock is tapered from the open upper end toward the heel portion. In one construction, the upper end of the leg portion is knitted so that it has a section with a first diameter and a first length. The leg portion continues with a mid-section that has a diameter smaller than the first diameter and a length greater than the first length. It is also possible for the diameter of the mid-section to decrease from the region where the mid-section is connected to the upper section toward the heel portion.

These aspects and advantages of the present invention, as well as others, will become apparent from the following description of the preferred embodiments which refer to the accompanying drawings.

DETAILED DESCRIPTION OF THE INVENTION

Figure 1:
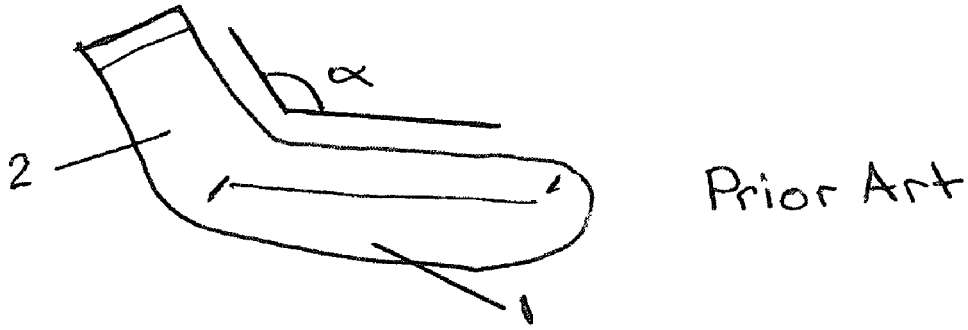
FIG. 1 is a side view of a prior art sock.

FIG. 1 shows a prior art sock in side view. As can be seen, such prior art socks have a foot portion 1 and a leg portion 2 that are at an obtuse angle $\alpha$ to one another.

Figure 2:
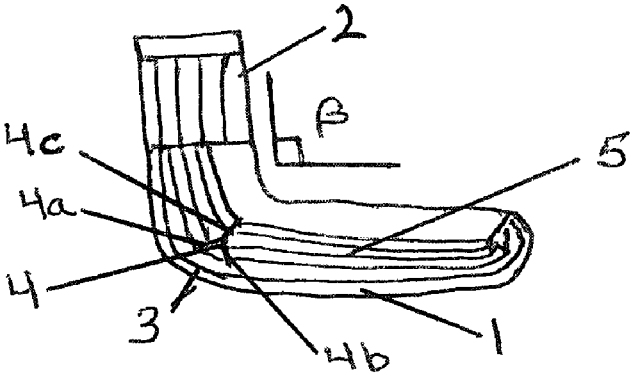
FIG. 2 is a side view of a first embodiment of the present invention.

FIG. 2 shows a sock pursuant to the present invention. As shown here, the foot portion 1 and the leg portion 2 are at an angle $\beta$ to one another of substantially 90°. This angle is obtained by providing a heel portion 3 between the foot portion 1 and the leg portion 2, which heel portion 3 has a double gore line 4 that is Y-shaped. The sock is knitted so that the wales or courses 5 turn 90° through the heel portion 3. This 90° turn is obtained by the double gore line which has a first gore line portion 4*a* and a second gore line portion 4*b* that extend downwardly from a vertex at an angle to one another. These gore line portions 4*a*, 4*b* allow the courses to bend at a sharper angle than was possible in the prior art and, thus, results in a sock which has a leg portion which is substantially 90° to the foot portion.

The double gore line can also have a gore line portion 4*c* that extends from the vertex of the line portions 4*a*, 4*b*, in a direction opposite the portions 4*a*, 4*b* toward the upper side of the sock.

Figure 3:
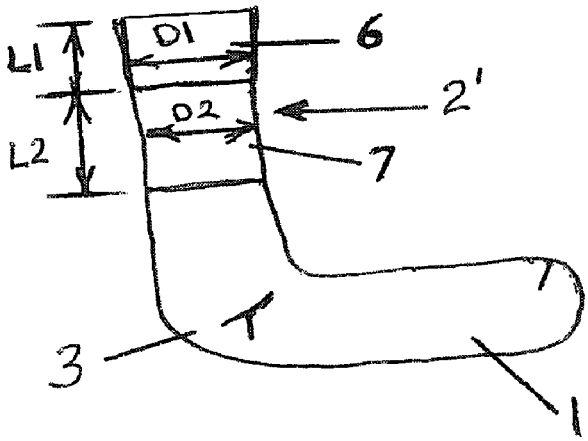
FIG. 3 is a side view of a second embodiment of the present invention.

FIG. 3 shows another embodiment of the invention in which the leg portion 2' has a first, top section 6 that is knitted to have a diameter D1 and a length L1. Adjacent to the top section 6 is a mid-section 7 that has a diameter D2 that is smaller than the diameter D1 of the adjacent top portion 6. The mid-section 7 also has a length L2 that is longer than the length L1 of the top section. The section D2 can also be knitted so that the diameter D2 decreases in the direction of the heel portion 3. This configuration of the leg portion permits the leg portion to better fit the lower leg of the wearer and thereby reduce the possibility of slipping down of the sock.

Without further analysis, the foregoing will so fully reveal the gist of the present invention that others can, by applying current knowledge, readily adapt various applications without omitting features that, from the standpoint of prior art, merely constitute essential characteristics of the generic or specific aspects of this invention.

What is claimed is new and desired to be protected by Letters Patent as set forth in the appended claims:

1. A sock, comprising:

a foot portion;

a leg portion; and a heel portion between the leg portion and the foot portion, the heel portion having only one gore line, the gore line being a Y-shaped double gore line consisting of two gore line portions at an angle to one another so as to meet at a vertex, and a further gore line portion that extends away from the vortex, so that the foot portion is at an angle of substantially 90° to the leg portion.

2. The sock according to claim 1, wherein the two gore line portions are of substantially equal length.

3. The sock according to claim 2, wherein the two gore line portions extend downwardly from the vertex.

4. The sock according to claim 3, wherein the further gore line portion extends away from the vertex of the two gore line portions toward an upper surface of the sock, the further gore line portion being longer than the two gore line portions.

5. The sock according to claim 1, wherein the leg portion is tapered from an upper end toward the heel portion.

6. A sock according to claim 5, wherein the upper end of the leg portion has a first section with a first diameter and a first length, and a mid-section adjacent the upper section, the mid-section having a second diameter and a second length, the first diameter being greater than the second diameter and the first length being shorter than the second length.

7. The sock according to claim 6, wherein the second diameter decreases from a region adjacent the upper section toward the heel portion.

8. A sock, comprising:

a foot portion;

a leg portion; and a heel portion between the leg portion and the foot portion, the leg portion being tapered from an upper end toward the heel portion, wherein the upper end of the leg portion has a first section with a first diameter and a first length, and a mid-section adjacent the upper section, the mid-section having a second diameter and a second length, the first diameter being greater than the second diameter and the first length being shorter than the second length, the heel portion having only one gore line, the gore line being a Y-shaped double gore line consisting of two gore line portions at an angle to one another so as to meet at a vertex, and a further gore line portion that extends away from the vortex, so that the foot portion is at an angle of substantially 90° to the leg portion.

9. The sock according to claim 8, wherein the second diameter decreases from a region adjacent the upper section toward the heel portion.

* * * * *